US012297018B2

(12) United States Patent
Smyth et al.

(10) Patent No.: US 12,297,018 B2
(45) Date of Patent: May 13, 2025

(54) LOCKING CAP FOR BEVERAGE CANS

(71) Applicants: Bryan Smyth, Burlington (CA); Nicholas McCarron, Hamilton (CA); Maxwell Lidano Childerhose, Oakville (CA)

(72) Inventors: Bryan Smyth, Burlington (CA); Nicholas McCarron, Hamilton (CA); Maxwell Lidano Childerhose, Oakville (CA)

(73) Assignee: OTB Packaging Solutions Inc., Hamilton (CA)

( * ) Notice: Subject to any disclaimer, the term of this patent is extended or adjusted under 35 U.S.C. 154(b) by 0 days.

(21) Appl. No.: 18/322,654

(22) Filed: May 24, 2023

(65) Prior Publication Data

US 2023/0382612 A1 Nov. 30, 2023

Related U.S. Application Data

(60) Provisional application No. 63/345,248, filed on May 24, 2022.

(51) Int. Cl.
*B65D 51/20* (2006.01)
*B65D 51/00* (2006.01)

(52) U.S. Cl.
CPC ..... *B65D 51/20* (2013.01); *B65D 51/007* (2013.01)

(58) Field of Classification Search
CPC .... B65D 51/20; B65D 17/4012; B65D 41/26; B65D 2251/0015; B65D 2251/0071; B65D 2517/0041; B65D 50/04; B65D 51/007
See application file for complete search history.

(56) References Cited

U.S. PATENT DOCUMENTS 4,410,102 A * 10/1983 Lutzker ..... B65D 45/32 220/729
4,790,444 A * 12/1988 Terzi ..... B65D 25/48 220/714
5,176,278 A * 1/1993 Quarberg ..... B65D 51/20 220/729
5,209,362 A * 5/1993 Lutzker ..... B65D 51/20 220/729
5,785,198 A * 7/1998 Credle, Jr. ..... B65D 45/305 220/269

(Continued)

FOREIGN PATENT DOCUMENTS

KR 20060029871 A * 5/2014 ..... B65D 51/007
WO WO-2020096266 A1 * 5/2020 ..... B65D 17/506

OTHER PUBLICATIONS

English translation of KR-20060029871-A (2024).*
English translation of WO-2020096266-A1 (2024).*

*Primary Examiner* — James N Smalley
(74) *Attorney, Agent, or Firm* — HOLBECHE LAW; Kevin Edward Holbeche

(57) ABSTRACT

A locking cap for a beverage can includes an annular ring, an outer portion, an inner portion and an annular seal. The locking cap attaches to a beverage can and allows the beverage can to be resealed to prevent spills and loss of carbonation and enable the beverage can to be transported easily. In some embodiments, the locking cap is used for *cannabis* infused beverages and prevents unauthorized drinking of the beverage. Further, in some embodiments, the inner portion doubles as a dosing cup, allowing a user to accurately dose the beverage.

20 Claims, 11 Drawing Sheets

(56) References Cited

U.S. PATENT DOCUMENTS

| | | | | |
|---|---|---|---|---|
| 6,155,452 | A * | 12/2000 | Laurent | B65D 81/3876 220/737 |
| 6,341,706 | B1 * | 1/2002 | Neuner | B65D 51/32 222/570 |
| 9,051,074 | B2 * | 6/2015 | Lonsway | B65D 41/34 |
| 2004/0035869 | A1 * | 2/2004 | Laurent | B65D 51/20 215/218 |
| 2004/0060935 | A1 * | 4/2004 | Perra | B65D 47/265 220/253 |
| 2006/0237471 | A1 * | 10/2006 | Aafjes | B65D 25/48 220/729 |
| 2008/0302752 | A1 * | 12/2008 | Farrar | B65D 51/20 215/200 |
| 2015/0210465 | A1 * | 7/2015 | Raad | B65D 47/122 220/592.16 |

* cited by examiner

LOCKING CAP FOR BEVERAGE CANS

CROSS-REFERENCE TO RELATED APPLICATION

The present application is related to and claims priority to U.S. Provisional Patent Application No. 63/345,248 filed May 24, 2022, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of beverage containers of existing art and more specifically relates to a locking cap for a beverage can.

RELATED ART

Beverage cans have been a popular packaging choice for soft drinks, energy drinks, alcoholic beverages, *cannabis*-infused beverages etc. for many years. However, one issue with traditional beverage cans is that once they are opened, there is no way to reseal them. When a beverage can is opened and unable to be re-sealed, several consequences may arise.

For example, without a proper seal, liquids can spill or leak from the can, causing a mess and potentially damaging nearby objects or surfaces. Further, the absence of resealing options may limit the portability and convenience of the beverage, as it becomes challenging to transport without the risk of spillage or contamination. In addition to this, exposure to air can lead to rapid loss of carbonation in carbonated drinks, resulting in a flat and less enjoyable beverage.

*Cannabis*-infused beverages and alcoholic beverages are typically provided in cans that outwardly appear as a generic soda can, particularly to children. As such, the lack of seals on these cans can pose a potential risk to children, who, due to their inquisitive nature, often try to consume substances that are readily accessible to them. As such, a suitable solution is desired.

SUMMARY OF THE INVENTION

In view of the foregoing disadvantages inherent in the known beverage closure art, the present disclosure provides a novel locking cap for beverage cans. The general purpose of the present disclosure, which will be described subsequently in greater detail, is to provide a cap that can be placed over a beverage can top to temporarily seal the beverage can, thereby preventing spills, loss of carbonation and unauthorized access, and enabling the beverage can to be easily transported.

A locking cap for a beverage can is disclosed herein. The beverage can may include a can top having a top plate and a peripheral rim. In some embodiments, the locking cap may include an annular ring, an outer portion, an inner portion, and an annular seal. The annular ring may be configured to attach to the peripheral rim of the beverage can and may include a plurality of locking grooves spaced equally around an exterior surface thereof. The outer portion, or outer cap, may include a closed top opposite a first open bottom having a circumferential annular rim, and a plurality of locking tabs spaced equally around an interior of the outer portion. Each of the plurality of locking tabs may be configured for engagement with one of the plurality of locking grooves to lock the locking cap to the beverage can.

The inner portion may be removably housed within an interior of the outer portion and able to rotate freely therewithin. The inner portion may include a top opposite a second open bottom having a first circumferential collar, a second circumferential collar located above the first circumferential collar and a circumferential groove therebetween. Further, in some embodiments, the inner portion may include an interior capacity sized to receive an amount of the beverage from the beverage can. The annular seal may be removably housed within the circumferential groove and configured to seal against the top plate of the beverage can.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a locking cap for beverage cans, constructed and operative according to the teachings of the present disclosure.

The various embodiments of the present invention will hereinafter be described in conjunction with the appended drawings, wherein like designations denote like elements.

DETAILED DESCRIPTION

Figure 1:
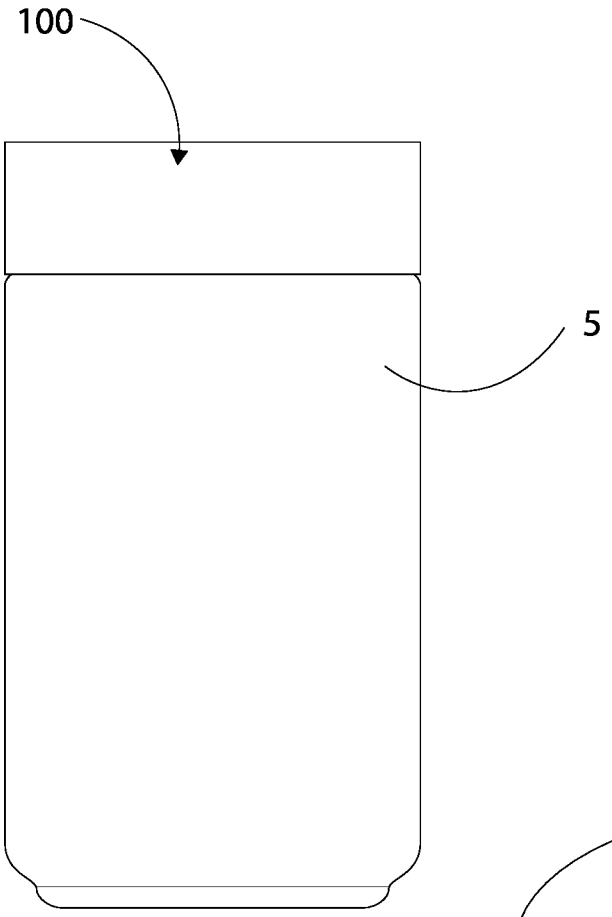
FIG. 1 is a front view of a locking cap attached to a beverage can, according to an embodiment of the disclosure.

As discussed above, embodiments of the present disclosure relate to a locking cap for a beverage can. Generally, the locking cap may include an outer cap, an inner disc or inner cup, a locking ring and a seal. The outer cap may function as a shell, or housing, to house the inner components of the locking cap therein. In some embodiments, the inner cup may be used to accurately dose a beverage from the beverage can. This may be useful for infused beverages, particularly *cannabis* infused beverages. The locking cap may also be child-resistant, thus preventing children from accidentally consuming *cannabis* infused beverages (or other beverages such as alcoholic beverages).

The locking cap may be made from a plastic material. For example, the plastic material may include, but is not limited to, 100% recycled plastic, bio plastics, polyethylene terephthalate (PET), polypropylene, synthetic resin, or the like. Further, the locking cap may include indicia, such as logos, advertisements, or the like.

Referring now more specifically to the drawings by numerals of reference, there is shown in FIGS. 1-16, various views of a locking cap for a beverage can ("locking cap" 100). As shown in these figures, the locking cap 100 may include an annular ring 110, an outer portion 120, an inner portion 130, and an annular seal 140.

Figure 2:
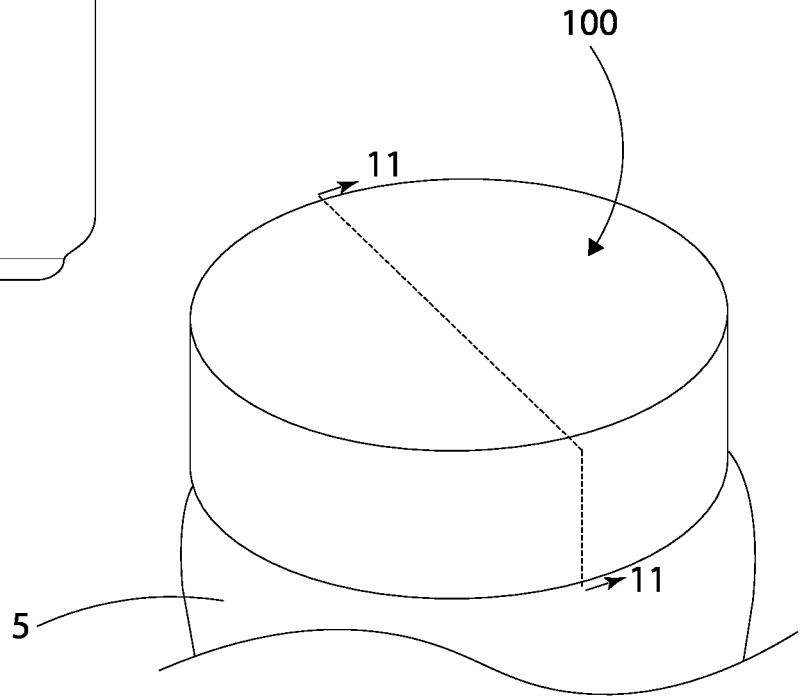
FIG. 2 is a side perspective view of the locking cap attached to the beverage can, according to an embodiment of the disclosure.
Figure 3:
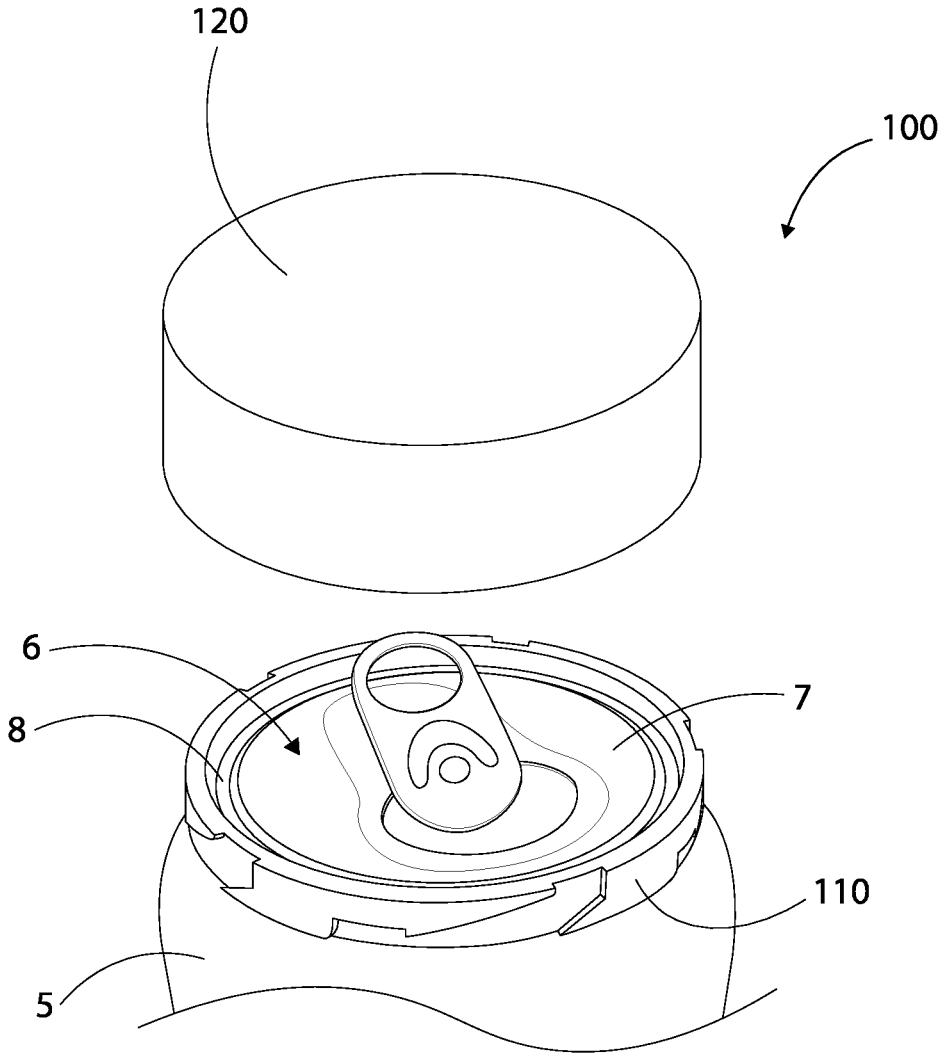
FIG. 3 is a partial exploded view of the locking cap and the beverage can and illustrating an annular ring of the locking cap attached to a peripheral rim of the beverage can, according to an embodiment of the present disclosure.

FIGS. 1-2 illustrate the locking cap 100 attached to the beverage can 5. As shown in FIG. 3, the beverage can 5 may include a can top 6 having a top plate 7 and a peripheral rim 8. As shown, particularly, the annular ring 110 may be configured to attach to the peripheral rim 8 of the beverage can 5. For example, in some embodiments, an inner surface of the annular ring 110 may include a plurality of hook latches configured latch to the peripheral rim 8 and allow the annular ring 110 to sit underneath the peripheral rim 8 until it is removed by a user. In some embodiments, the annular ring 110 may be provided in a variety of sizes to accommodate a variety of beverage can sizes.

Figure 4:
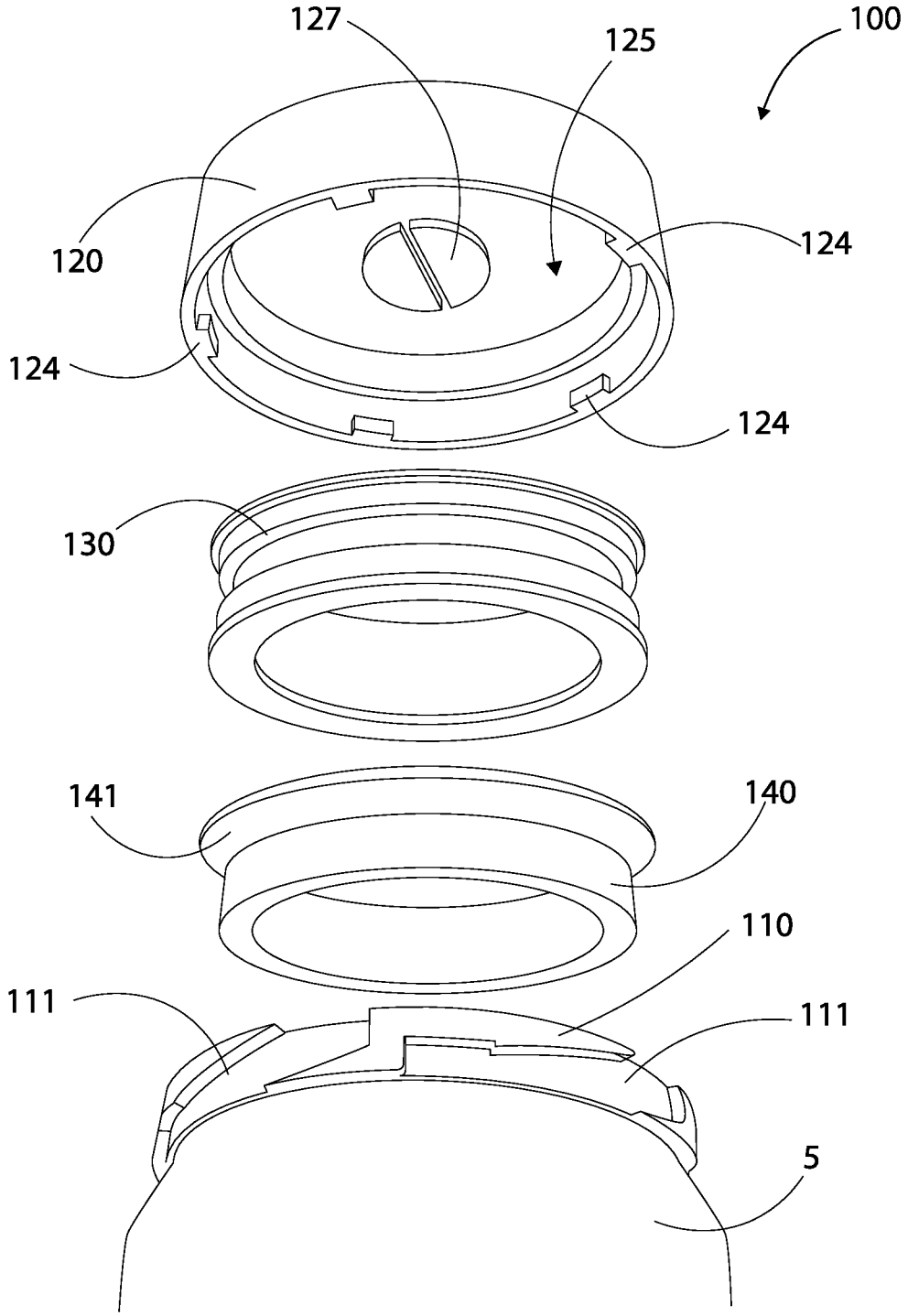
FIG. 4 is an exploded view of the locking cap including the annular ring, an annular seal, an inner portion and an outer portion, according to an embodiment of the present disclosure.
Figure 5:
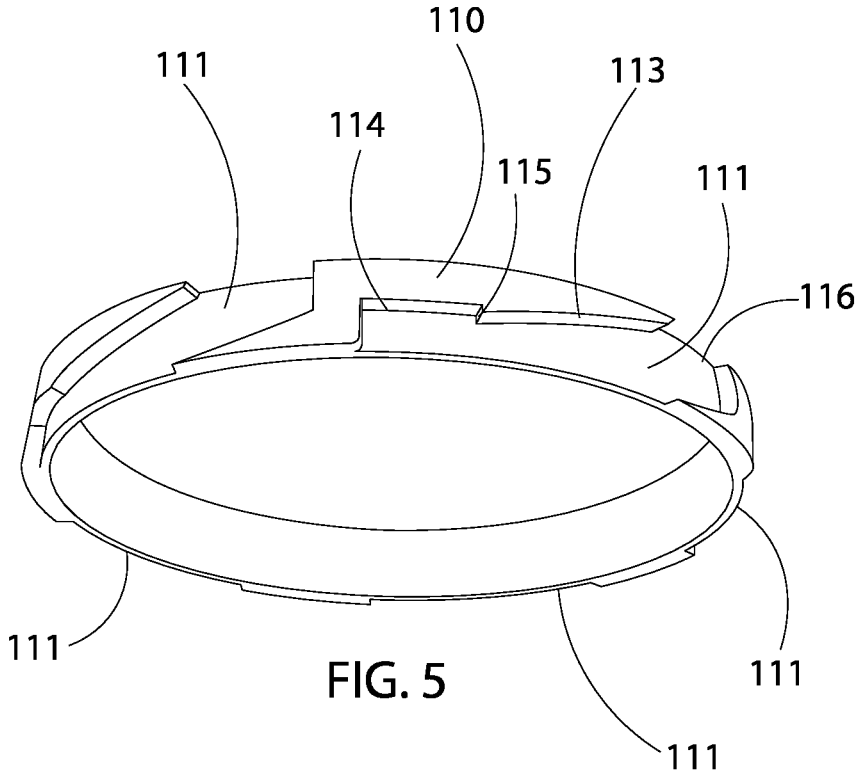
FIG. 5 is a bottom perspective view of the annular ring, according to an embodiment of the disclosure.

As shown in FIGS. 4-5, the annular ring 110 may include a plurality of locking grooves 111 spaced equally therearound. As shown in FIG. 4, the outer portion 120 may include a plurality of locking tabs 124 spaced equally around an interior 125 of the outer portion 120 (attached to an interior surface) and each configured for engagement with one of the plurality of locking grooves 111 to lock the locking cap 100 to the beverage can 5. In some embodiments, as shown, the plurality of locking grooves 111 may include five locking grooves, and the plurality of locking tabs 124 include five locking tabs. Further, as shown in FIG. 4, the interior 125 of the outer portion 120 may include a circumferential ledge 126 configured to prevent the annular ring 110 from sliding into the interior 125 of the outer portion 120.

Figure 7:
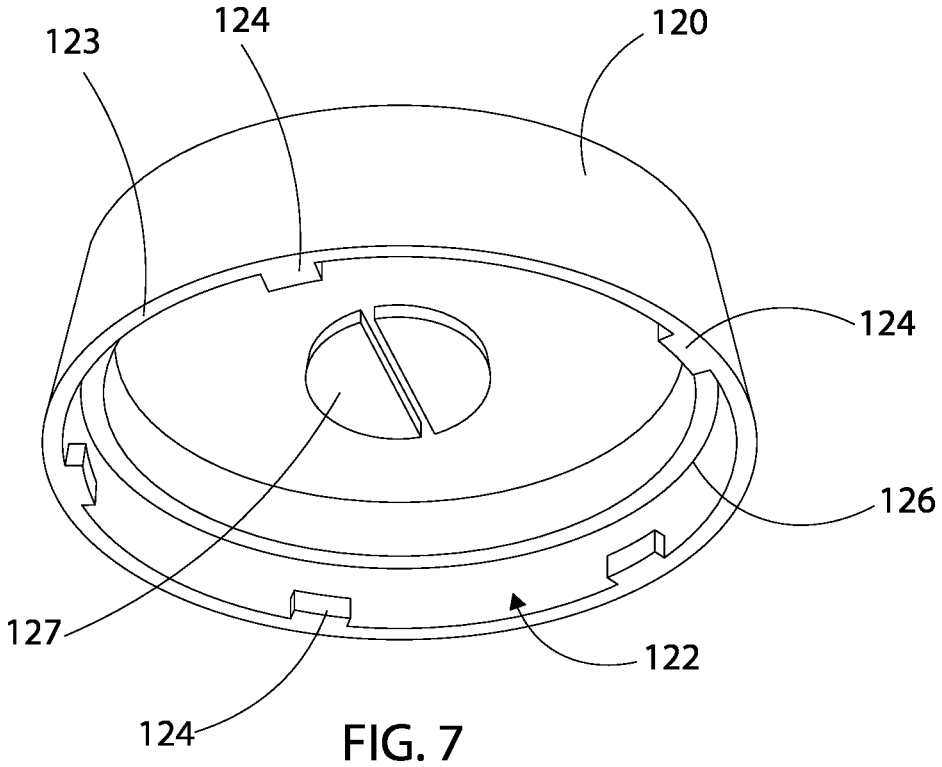
FIG. 7 is a bottom perspective view of the outer portion, according to an embodiment of the disclosure.

As shown in FIG. 5, the plurality of locking grooves 111 may include a slanted groove portion 113 terminating with a lip 115 and transitioning into a linear groove portion 114 that is disposed slightly above the end of the slanted groove portion 113 to define the lip 115. As shown in FIG. 4 and FIG. 7, the plurality of locking tabs 124 may each include a size and shape each configured to insert into a groove entrance 116 (FIG. 5) of the locking groove 111, move along the slanted groove portion 113 when the outer portion 120 is twisted onto the annular ring 110 and seat within the linear groove portion 114. The lip 115 prevents the outer portion 120 from being twisted and removed and thus locks the locking cap 100 to the beverage can 5. This may cause the outer portion 120 to apply downward pressure onto the inner portion 130.

To remove the locking cap 100, a user may apply a downward force (i.e., push down) on the outer portion 120, moving the locking tab 124 downward, below the lip 115 of the slanted groove portion 113, such that it is able to be twisted back along the slanted groove portion 113 and removed from the annular ring 110.

Figure 6:
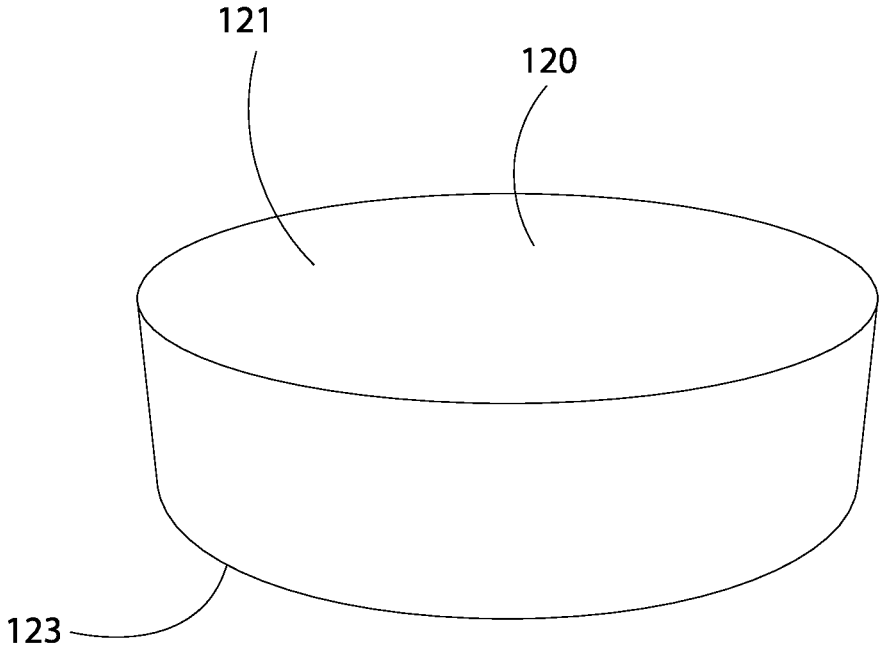
FIG. 6 is a top perspective view of the outer portion, according to an embodiment of the disclosure.

As discussed above, the outer portion 120 may be an outer cap—i.e., the outermost portion of the locking cap 100 into which the other components (130, 140) are housed. As such, as shown in FIGS. 6-7, the outer portion 120 may include a closed top 121 opposite a first open bottom 122 having a circumferential annular rim 123. In some embodiments, the plurality of locking tabs 124 may be located about the circumferential annular rim 123 or attached to the circumferential annular rim 123, extending outwardly and perpendicular therefrom.

Figure 8:
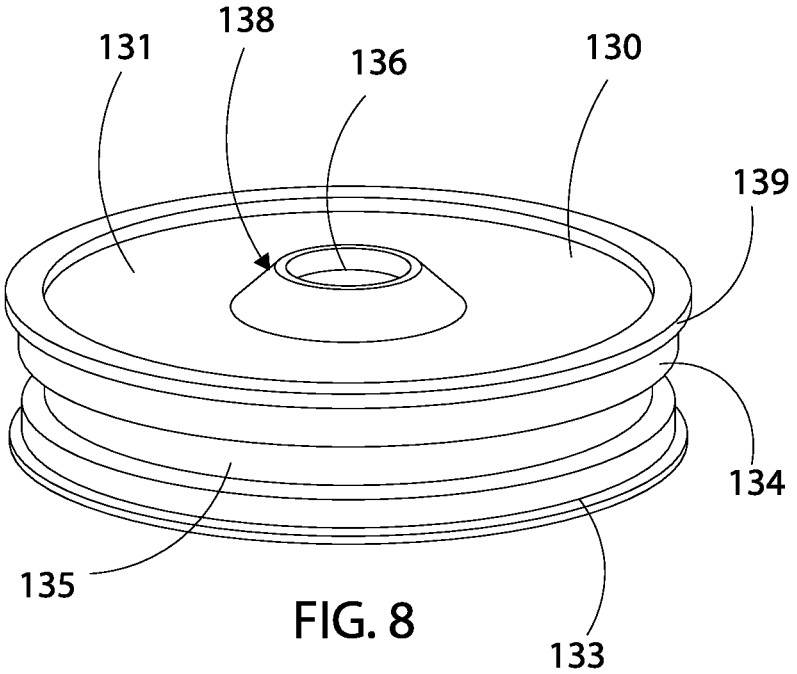
FIG. 8 is a top perspective view of the inner portion, according to an embodiment of the disclosure.

The inner portion 130 may be removably housed within the interior 125 of the outer portion 120 and able to rotate freely therewithin, about a vertical axis that is central to the outer portion 120 and the inner portion 130 when attached together. As shown in FIG. 7, in some embodiments, the interior 125 of the outer portion 120 may include a protrusion 127 attached to the top 121 of the outer portion 120 and extending downwardly therefrom, and as shown in FIG. 8, an exterior of the inner portion 130 may include a slot 136 at a top 131 of the inner portion 130 configured to receive the protrusion 127, thereby attaching the inner portion 130 to the outer portion 120. It should be appreciated however that the inner portion 130 and the outer portion 120 are not limited to this means of attachment.

Figure 9:
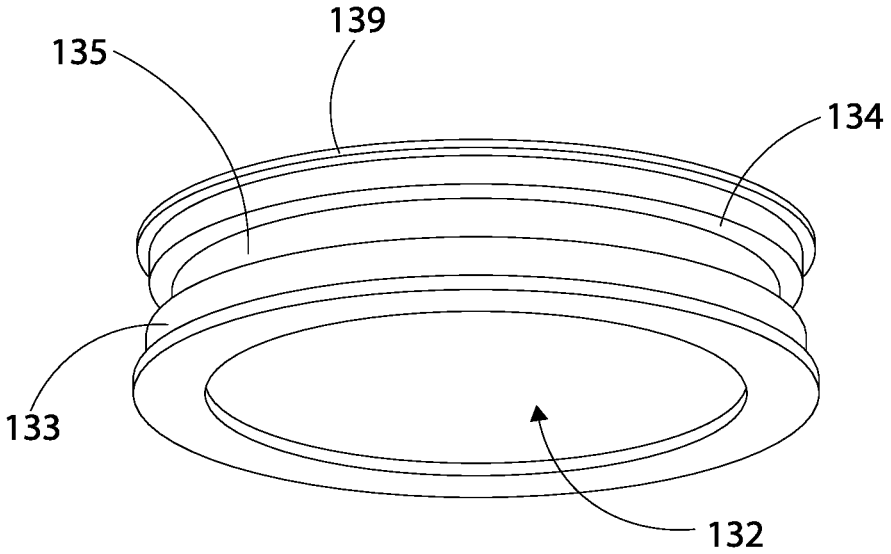
FIG. 9 is a bottom perspective view of the inner portion, according to an embodiment of the disclosure.

As shown in FIGS. 8-9, the inner portion 130 may include the top 131 opposite a second open bottom 132 having a first circumferential collar 133, and a second circumferential collar 134 located above the first circumferential collar 133. In some embodiments, as shown, the inner portion 130 may further include a circumferential lip 139 above the second circumferential collar 134. In addition, as shown in FIG. 8, the inner portion 130 may, in some embodiments, include a raised center 138 able to receive a raised top plate 7 of the beverage can 5. Particularly, the raised center 138 of the inner portion 130 may enable the locking cap 100 to be attached to beverage cans 5 still having a pull tab (for opening the beverage can 5) in place and/or on bowed beverage can tops 6.

Figure 10:
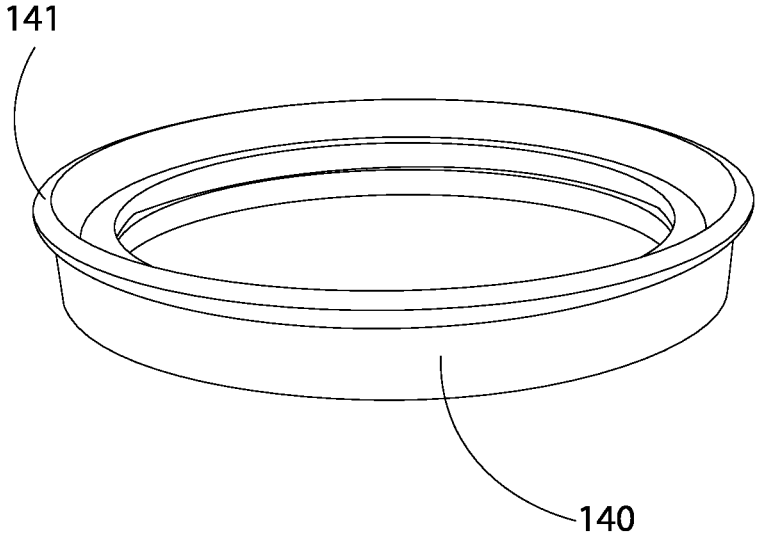
FIG. 10 is a top perspective view of the annular seal, according to an embodiment of the disclosure.
Figure 11:
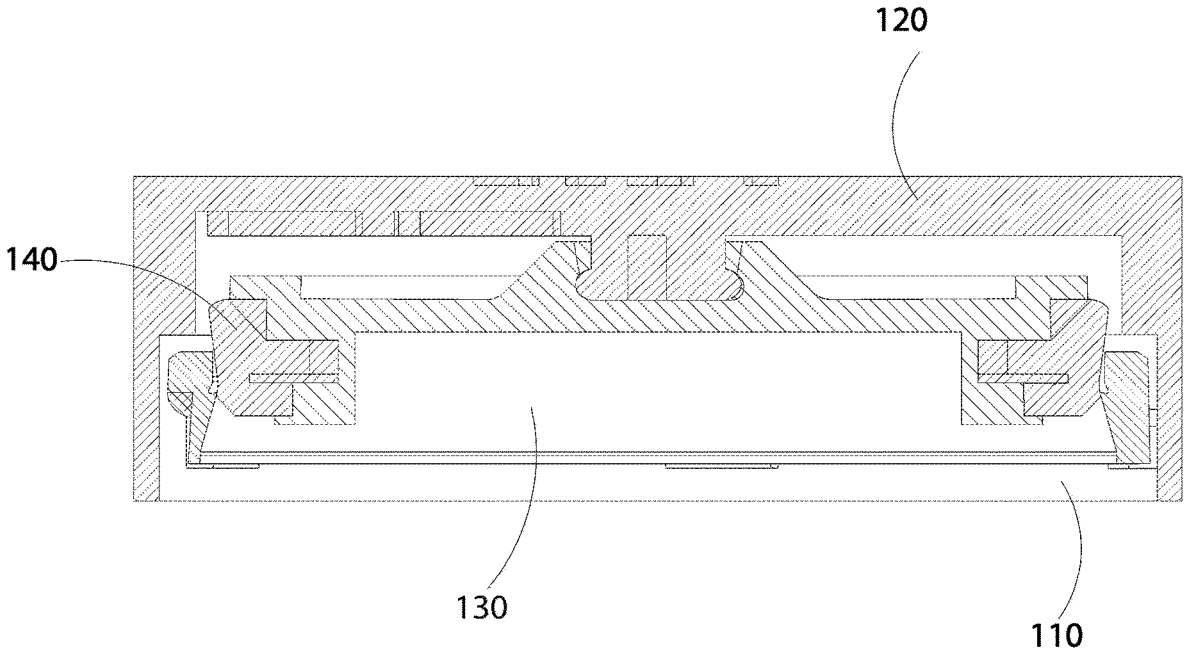
FIG. 11 is a cross-section view of the locking cap taken from line 11-11 in FIG. 2, according to an embodiment of the disclosure.
Figure 12:
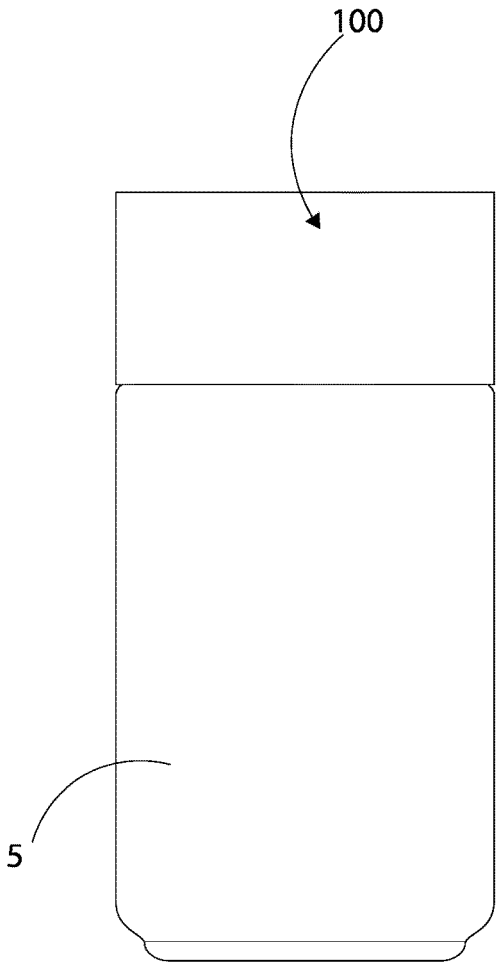
FIG. 12 is a front view of the locking cap attached to the beverage can and including an inner dosing cup, according to another embodiment of the disclosure.
Figure 13:
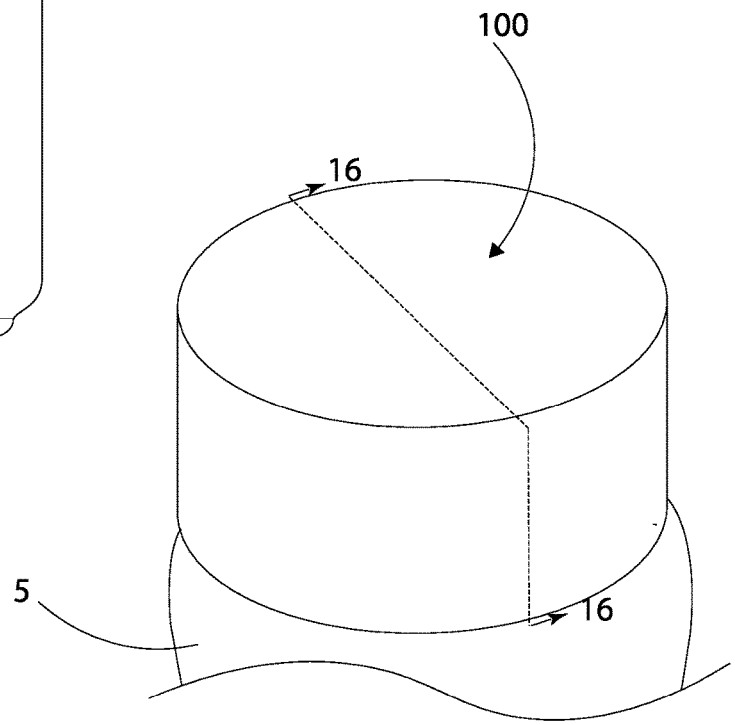
FIG. 13 is a side perspective view of the locking cap attached to the beverage can, according to an embodiment of the disclosure.

Defined between the first circumferential collar 133 and the second circumferential collar 134 may be a circumferential groove 135. As shown in FIGS. 10-11, the annular seal 140 may be removably housed within the circumferential groove 135 and held underneath the circumferential lip 139. Particularly, the annular seal 140 may be configured to seal against the top plate 7 of the beverage can 5. This may prevent the beverage from being inadvertently spilled out of the beverage can 5 and into the outer 120 or inner portion 130. In some embodiments, the annular seal 140 may be configured to press and sprawl across the top plate 7 of the beverage can 5. Further, the annular seal 140 may include a peripheral neck 141 that abuts the second circumferential collar 134 when seated within the circumferential groove 135.

Figure 14:
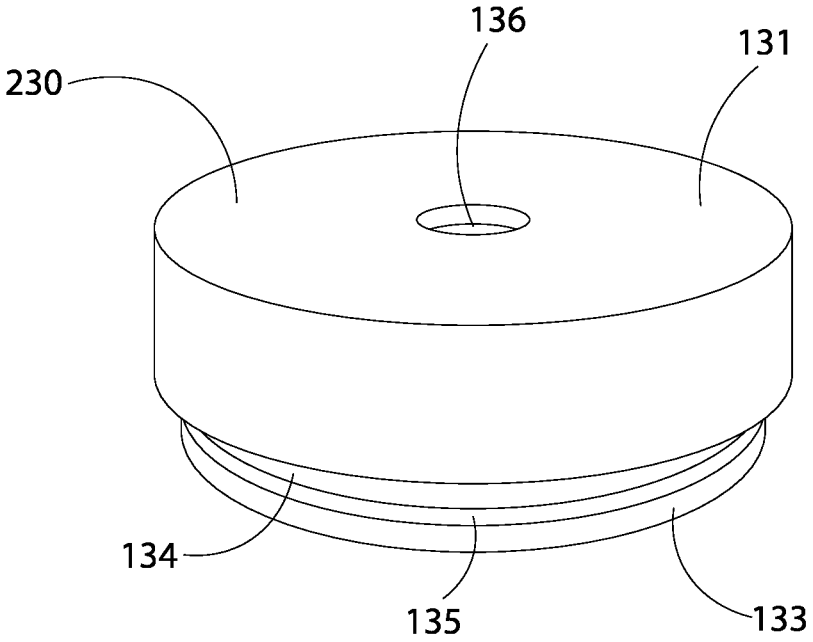
FIG. 14 is a top perspective view of the inner portion wherein the inner portion includes the inner dosing cup, according to an embodiment of the disclosure.
Figure 15:
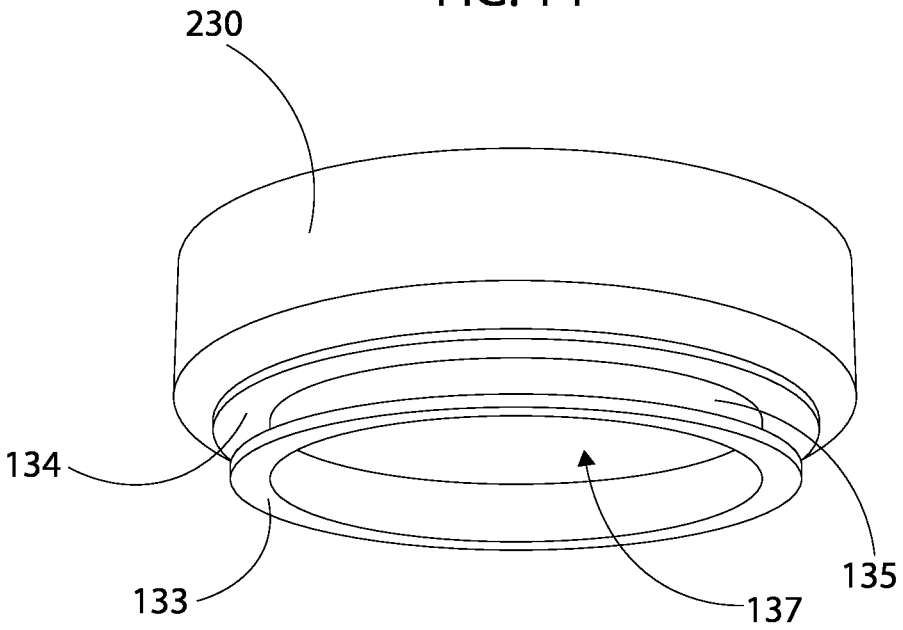
FIG. 15 is a bottom perspective view of the inner dosing cup, according to an embodiment of the disclosure.
Figure 16:
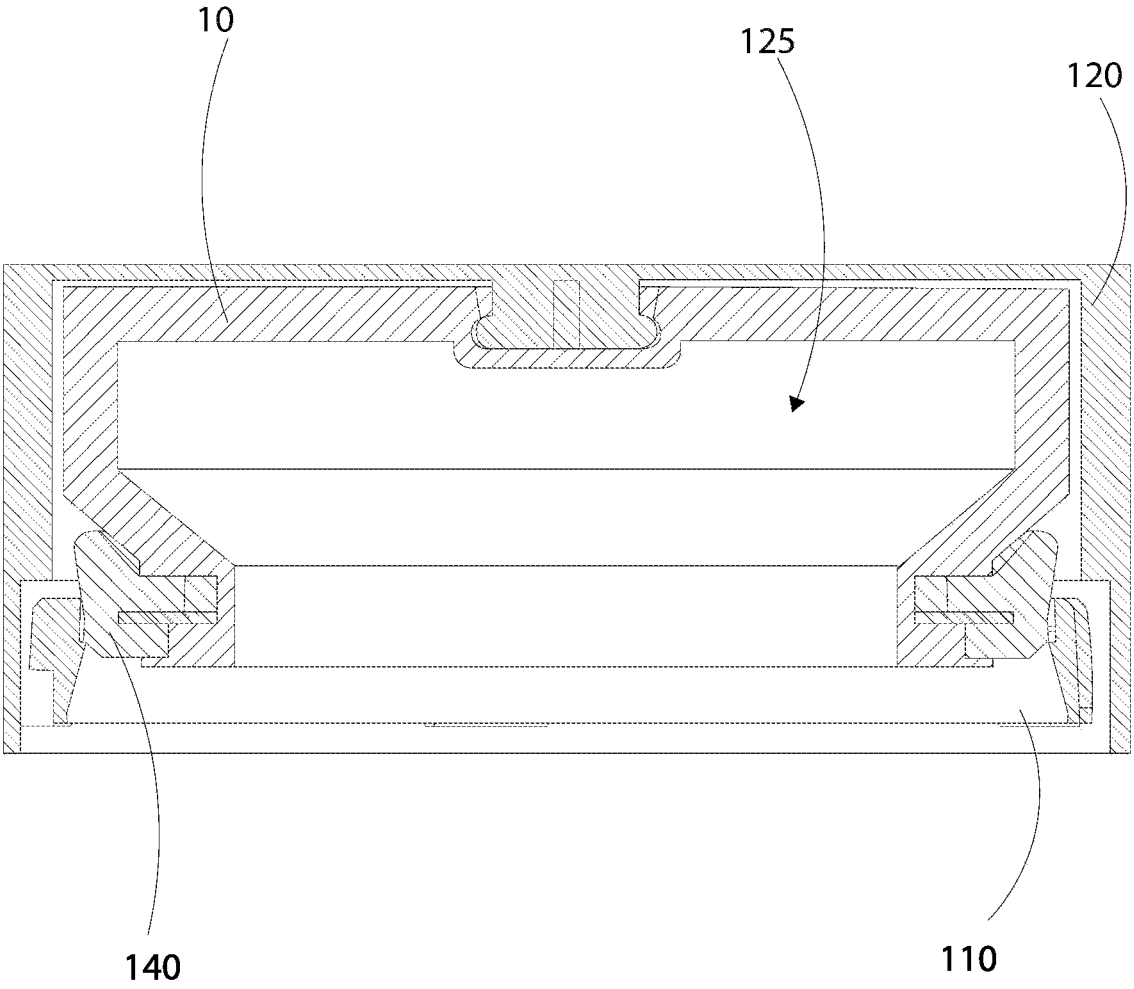
FIG. 16 is a cross-section view of the locking cap taken from line 16-16 in FIG. 13, according to an embodiment of the disclosure.

In some embodiments, as demonstrated in FIGS. 8-9, the inner portion 130 may include a generally disc-like configuration. In other embodiments, as shown in FIGS. 12-16, the inner portion 130 may include an inner cup 230 for use in dosing portions of the beverage. For example, as shown in FIGS. 14-15, the inner cup 230 may include an interior capacity 137 sized to receive an amount of the beverage from the beverage can 5. As such, the top 131 of the inner cup 230 may be closed. In some examples, the interior capacity 137 may be sized to receive between 0-35 ml of the beverage. It should however be appreciated that the interior capacity 137 is not limited to this capacity and in some embodiments a variety of sizes may be provided. Further, in some embodiments, one or more measurement lines (not illustrated) may be provided at an interior surface of the inner cup 230, allowing accurate dosing of the beverage. This may be particularly useful for medicinal and recreational beverages, such as (but not limited to) *cannabis* beverages.

In use, the user may attach the annular ring 110 to the peripheral rim 8 of the beverage can 5 and then press the locking cap 100 onto the beverage can 5 firmly, attaching the outer portion 120 to the inner portion 130 and attaching the outer portion 120 to the annular ring 110. When desired, the user may press down and twist the locking cap 100 to remove the locking cap 100 and drink the beverage. In some embodiments, once the locking cap 100 is removed, the inner portion 130 (i.e., inner cup 230) may be used by the user to accurately dose the beverage and drink the dose from the inner cup 230. To replace the locking cap 100, the user may again twist the locking cap 100 onto the annular ring 110.

It should also be noted that, under appropriate circumstances, considering such issues as design preference, user preferences, marketing preferences, cost, structural requirements, available materials, technological advances, etc., other methods are taught herein.

It should also be noted that, in this specification and the drawings, some elements that have substantially the same function and structure are denoted with the same reference signs, and repeated explanation omitted. It should also be appreciated that common but well understood elements that are useful or necessary in a commercially feasible embodiment are often not depicted throughout in order to facilitate a clearer view of the various embodiments of the present invention.

It should be understood by one of skill in the art that the disclosed invention is described here in a few exemplary embodiments of many. No particular terminology or description should be considered limiting on the disclosure or the scope of any claims issuing therefrom.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

What is claimed is:

1. A locking cap for a beverage can, the beverage can including a can top having a top plate and a peripheral rim, the locking cap comprising;

an annular ring configured to attach to the peripheral rim of the beverage can, the annular ring including a plurality of locking grooves spaced equally around an exterior surface thereof;

an outer portion including a closed top opposite a first open bottom having a circumferential annular rim, and a plurality of locking tabs spaced equally around an interior of the outer portion, each of the plurality of locking tabs configured for engagement with a respective one of the plurality of locking grooves to lock the locking cap to the beverage can;

an inner portion removably housed within an interior of the outer portion and able to rotate freely therewithin, the inner portion including a top opposite a second open bottom having a first circumferential collar, a second circumferential collar located above the first circumferential collar, and a circumferential groove defined between the first circumferential collar and the second circumferential collar; and an annular seal removably housed within the circumferential groove, the annular seal configured to seal against the top plate of the beverage can.

2. The locking cap of claim 1, wherein the interior of the outer portion includes a circumferential ledge configured to prevent the annular ring from sliding into the interior of the outer portion.

3. The locking cap of claim 2, wherein the interior of the outer portion includes a protrusion attached to the top of the outer portion and extending downwardly therefrom, and wherein an exterior of the inner portion includes a slot at the top of the inner portion configured to receive the protrusion, thereby attaching the inner portion to the outer portion.

4. The locking cap of claim 3, wherein the plurality of locking grooves include five locking grooves, and wherein the plurality of locking tabs include five locking tabs.

5. The locking cap of claim 4, wherein the plurality of locking grooves each comprise a slanted groove portion.

6. The locking cap of claim 5, wherein the inner portion includes a raised center able to receive a raised top plate of the beverage can.

7. The locking cap of claim 1, wherein the inner portion includes an inner cup having an interior capacity, and wherein the interior capacity is sized to receive an amount of the beverage from the beverage can.

8. The locking cap of claim 7, wherein the interior capacity is sized to receive between 0-35 ml of the beverage.

9. The locking cap of claim 8, wherein the top of the inner portion is closed.

10. A locking cap for a beverage can, the beverage can including a can top having a top plate and a peripheral rim, the locking cap comprising:

an annular ring configured to attach to the peripheral rim of the beverage can, the annular ring including a plurality of locking grooves spaced equally around an exterior surface thereof;

an outer cap including a closed top opposite a first open bottom having a circumferential annular rim, a protrusion attached to the closed top at an interior of the outer cap, and a plurality of locking tabs spaced equally around the interior of the outer cap, each of the plurality of locking tabs configured for engagement with a respective one of the plurality of locking grooves to lock the locking cap to the beverage can;

an inner disc including a top opposite a second open bottom having a first circumferential collar, a second circumferential collar located above the first circumferential collar, a circumferential groove defined between the first circumferential collar and the second circumferential collar, and a slot disposed in the top at an exterior of the inner portion configured to receive the protrusion in the outer cap, thereby attaching the inner disc to the outer cap; and an annular seal removably housed within the circumferential groove, the annular seal configured to seal against the top plate of the beverage can.

11. The locking cap of claim 10, wherein the interior of the outer cap includes a circumferential ledge configured to prevent the annular ring from sliding into the interior of the outer cap.

12. The locking cap of claim 11, wherein the plurality of locking grooves include five locking grooves, and wherein the plurality of locking tabs include five locking tabs.

13. The locking cap of claim 12, wherein the plurality of locking grooves each comprise a slanted groove portion.

14. The locking cap of claim 10, wherein the top of the inner disc is closed.

15. A locking cap for a beverage can, the beverage can including a can top having a top plate and a peripheral rim, the locking cap comprising;

an annular ring configured to attach to the peripheral rim of the beverage can, the annular ring including a plurality of locking grooves spaced equally around an exterior surface thereof;

an outer cap including a first closed top opposite a first open bottom having a circumferential annular rim, and a plurality of locking tabs spaced equally around the interior of the outer cap, each of the plurality of locking tabs configured for engagement with a respective one of the plurality of locking grooves to lock the locking cap to the beverage can;

an inner cup removably housed within an interior of the outer cap and able to rotate freely therewithin, the inner cup including a second closed top opposite a second open bottom having a first circumferential collar, a second circumferential collar located above the first circumferential collar, a circumferential groove defined between the first circumferential collar and the second circumferential collar, and an interior capacity sized to receive an amount of the beverage from the beverage can; and an annular seal removably housed within the circumferential groove, the annular seal configured to seal against the top plate of the beverage can.

16. The locking cap of claim 15, wherein the interior capacity is sized to receive between 0-35 ml of the beverage.

17. The locking cap of claim 15, wherein the plurality of locking grooves include five locking grooves, and wherein the plurality of locking tabs include five locking tabs.

18. The locking cap of claim 17, wherein the plurality of locking grooves each comprise a slanted groove portion.

19. The locking cap of claim 15, wherein the interior of the outer cap includes a circumferential ledge configured to prevent the annular ring from sliding into the interior of the outer cap.

20. The locking cap of claim 19, wherein the interior of the outer cap includes a protrusion attached to the top of the outer cap and extending downwardly therefrom, and wherein an exterior of the inner cup includes a slot at the top of the inner cup configured to receive the protrusion, thereby attaching the inner cup to the outer cap.

* * * * *